United States Patent [19]

Vanderlyn

[11] 4,110,940

[45] Sep. 5, 1978

[54] ANCHORING SYSTEM

[76] Inventor: Donald Vanderlyn, Burger Rd., West Shokan, N.Y. 12481

[21] Appl. No.: 842,555

[22] Filed: Oct. 17, 1977

[51] Int. Cl.[2] ..... E04H 12/20; E02D 5/80; E06B 3/54

[52] U.S. Cl. ..... 52/23; 52/148; 52/DIG. 11; 248/508; 24/163 R; 24/197

[58] Field of Search ..... 24/163, 197, 269; 248/508, 509; 52/23, 148, DIG. 11, 157

[56] References Cited

U.S. PATENT DOCUMENTS

| | | | |
|---|---|---|---|
| 609,872 | 8/1898 | Campbell | 24/269 |
| 3,131,450 | 5/1964 | Zinkel | 24/197 |
| 3,747,288 | 7/1973 | Grimelii | 52/DIG. 11 |
| 3,754,733 | 8/1973 | Foster | 52/DIG. 11 |
| 3,774,364 | 11/1973 | Johnson | 52/23 |
| 3,830,457 | 8/1974 | Stewart | 248/508 |
| 3,845,597 | 11/1974 | Foster | 52/157 |
| 3,848,367 | 11/1974 | Barnes | 52/157 |

*Primary Examiner*—James L. Ridgill, Jr.
*Attorney, Agent, or Firm*—John Maier, III

[57] ABSTRACT

An anchoring system for use in anchoring structures such as mobile homes to the ground by use of elongated flexible belts. The belt is wound so as to be firmly clamped by its own tension.

10 Claims, 9 Drawing Figures

ANCHORING SYSTEM

BACKGROUND OF THE INVENTION

1. Field of the Invention

The present invention relates to improvements in a system used to anchor structures and more particularly, to a new and improved anchoring system where the strap is held firmly in place by the anchor housing under its own tension.

2. Description of the Prior Art

In the installation of structures, as for example, mobile homes it has been well-known that such structures, particularly where there is substantial wind, will blow over unless firmly held in place. Flexible belts, usually made from metal, are wrapped about the structure and anchored to the ground. Also, tie rods extend at an acute angle to the ground from the anchor housing to the lower portion of the structure. In order to accomplish this, an anchor housing must be secured to the ground. The flexible belt and tie rod are then wrapped around the structure and connected to the bottom of the structure, respectively.

Numerous anchoring devices have been known as, for example, those shown in the following patents:

| Inventor | U.S. Pat. No. |
|---|---|
| Barnes | 3,848,367 |
| Stewart | 3,830,457 |
| Foster | 3,754,733 |
| Grimelii | 3,747,288 |

Other patents show devices for various purposes but where an object is held down or together, as for example, the following:

| Inventor | U.S. Pat. No. |
|---|---|
| Johnson | 3,774,364 |
| Campbell | 609,872 |

One problem with existing anchoring apparatus is that it must be specially manufactured and cannot be put together in an inexpensive manner from available materials. Either special, perforated strap or slotted bolts are usually required. Frequently the housing of the anchoring apparatus is specially made to prevent rotation of the pin to which the strap is connected and tightened. As a result, the unit cost of each anchoring device is unduly high. In order to reduce the cost of securing a structure, frequently only an inadequate number of anchoring devices are used. The anchoring devices of the prior art are frequently not readily removable if firmly secured in the ground by concrete.

SUMMARY OF THE INVENTION

It is, therefore, an object of the present invention to provide an economical system for securing a structure to the ground preventing damage due to high winds and other serious weather conditions and a simple and efficient method of assemblying that system.

Another object is to provide an anchoring system which may be positively connected to the ground and still be removed and reused in a new location.

Another object is to provide an anchoring system which is readily installed.

Briefly, the present invention accomplishes these and other objects by providing flexible belts secured to pairs of anchor housings firmly connected to the ground with a tie rod connected from each anchor housing to the underside of the structure.

The flexible belt or strap is held rigidly in place on two pins in the anchor housing by its own tension. Tensioning of the strap is obtained by means of at least one hold-down bolt securely fastened in a vertical position in the ground with a threaded upper end. The hold-down bolt is located in a vertical hole in the anchor housing. A pair of nuts on the threaded end of the bolt secures the housing to the ground while providing tension for the belt. A turn buckle in the tie rod is provided to permit further tensioning of the tie rod.

Two pins are horizontally located in a common plane in the anchor housing. The first or outer pin is located at the end of the housing and the second or inner pin in a spaced relationship toward the inner portion of the anchor housing. The end of the flexible belt is bent under the first pin and the second pin, over the top of the second and first pin, under the first pin and diagonally over the second pin down under the second pin and the first pin and up between its own two layers resulting in three layers of the belt engaging against the outside of the first pin.

The invention will be described with reference to the accompanying drawings.

Before explaining the present invention in detail, it is to be understood that the invention is not limited in its application to the details of the construction and to the parts illustrated in the accompanying drawings since the invention is capable of other embodiments and of being practiced or carried out in various ways. Also it is to be understood that the phraseology or terminology employed herein is for the purpose of description and not of limitation.

DETAILED DESCRIPTION

Figure 2:
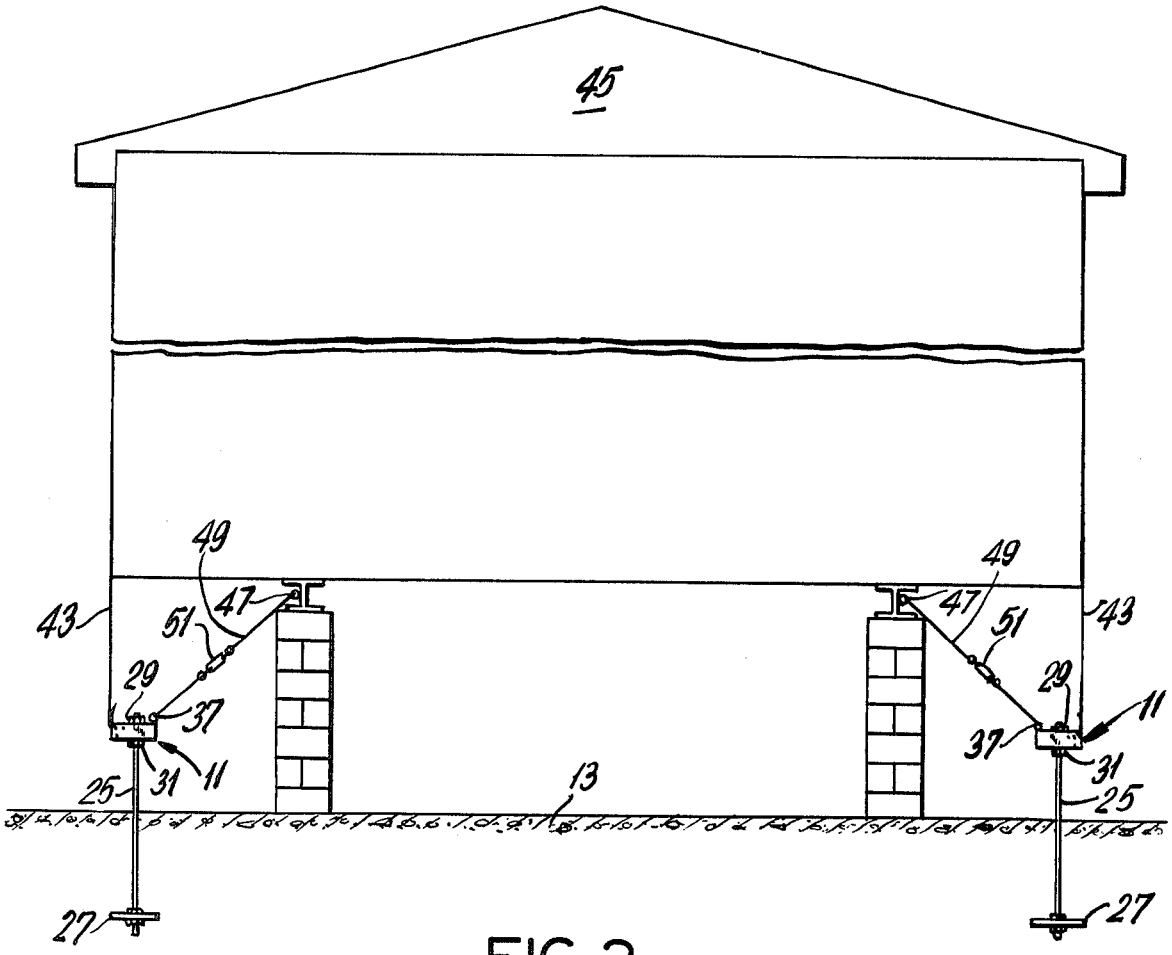
FIG. 2 is a side elevation showing the anchoring system connected to a structure with both the flexible band and the tie rod shown in place.

Referring now to the drawings, where like reference characters designate like or corresponding parts throughout the several views, there is shown in FIG. 2 the anchor housing 11 capable of being secured in place on a fixed foundation 13.

The anchor housing 11 is formed preferable from square hollow structural tubing approximately two inches by two inches with a length of approximately six inches. The upper corner of one end is beveled 15 at approximately a 45° angle and a pair of horizontally aligned openings 17, 19 are located at the same end as the bevel 15 so that the center of the outer holes 17 are substantially in line with the top of the bevel 15. A pair of inner openings or holes 19 are horizontally aligned with one another and are spaced on the same horizontal line approximately two inches away from the outer holes 17 toward the opposite end of the housing 11. A lower pair of horizontally aligned openings 21 may also be located directly in a vertical line below the outer pair of openings 17. The distance between the inner and outer pairs of openings 17, 19 and the outer and lower openings 17, 21 should be substantially the same. One or more pair of vertically aligned openings 23 are located approximately in the center of the anchor housing 11. Each of these vertically aligned openings 23 should be approximately three quarters of an inch in diameter.

A threaded shaft or bolt 25 is secured into a mounting block 27 secured in the ground 13 preferably in concrete so as not to be readily removed from the ground 13 by any unusual force. A pair of nuts 29, 31 are secured on the threaded shaft 25 both below the anchor housing 11 and above it. In this way, the anchor housing 11 may be raised or lowered to and from the ground 13. At the opposite end 33 from the bevel 15 of the anchor housing 11 a hole 35 is drilled only in the upper surface of the anchor housing 11 approximately three eighths by inches in diameter and approximately five-eighths of an inch from the end 33 of the anchor housing 11. A ring or hook 37 with a threaded extension (not shown), which serves as a fastening means, is located in the opening 35 and secured by a nut (not shown).

Figure 1:
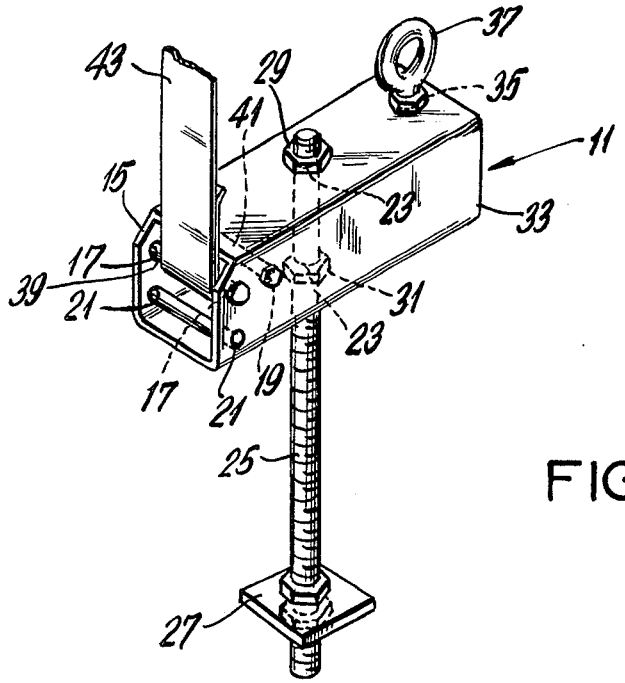
FIG. 1 is a perspective view of the anchor housing secured in place.

An outer pin 39 and an inner pin 41 are provided through each of the two upper openings 17, 19 as shown in FIGS. 1 and 3. Each of the pins 39, 41 may be a standard bolt threaded only at one end and secured by means of a bolt head at one end and a nut on the threaded end.

A strap or belt 43 is passed, as seen in FIG. 2, from a first anchor housing 11 up the side and over the top of a structure 45 and down the other side to a second anchor housing 11. Each strap 43 requires therefore two anchor housings 11, with each anchor housing 11 located directly beneath the edge of the structure 45 to be held in place. Each anchor housing 11 is located so that the belt 43 will extend vertically in line through the beveled corner 15, with the side wall of the structure 45. A hook or eyelet 47 is located toward the center of the structure 45. A tie rod 49 is connected at one end to the eyelet 47 on the structure 45 as the other end to the ring or hook 37 secured to the housing 11. Preferably a turn buckle 51 is provided about the center of the tie rod 49 for tensioning purposes.

As the belt 43 extends downwardedly from the side of the structure 45, it passes downwardedly around the outside of the outer pin 39 back and around and over the top of the inner pin 41 and again around and under the outer pin 39. The belt 43 then extends diagonally over the top of and around under the inner pin 41, and in between the two layers of the belt 43 against the outer pin 39. In this way, the belt 43 is pulled tight against the two pins 39, 41 and the pressure of the belt 43 on the outer and inner pins 39, 41 prevents the belt 43 from slipping.

Figure 3A:
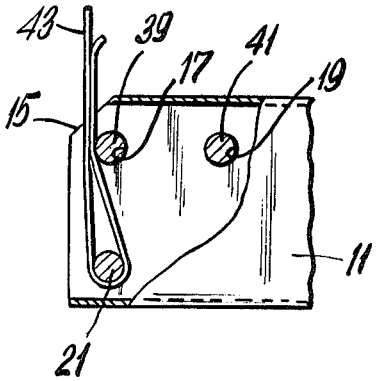
FIG 3*a* through 3*f* are cross-sectional, side views showing step one through six respectively used in forming the strap connection by means of the anchor housing.
Figure 3B:
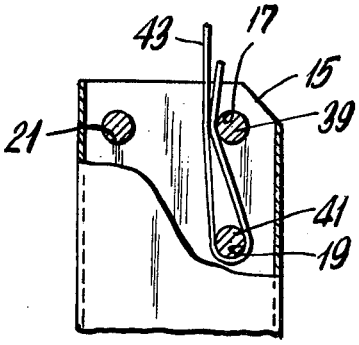
Figure 3C:
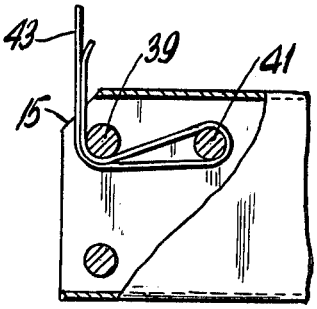
Figure 3D:
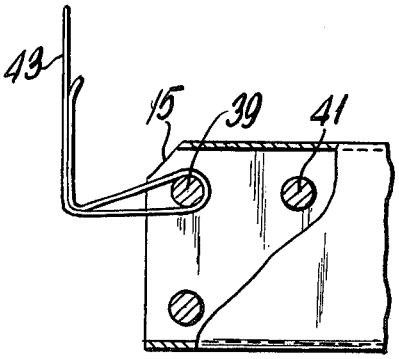
Figure 3E:
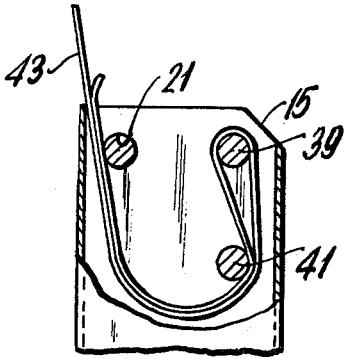
Figure 3F:
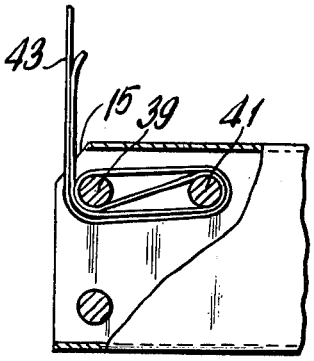

The anchor housing 11, providing a lower pair of openings 21 are available, may be used to form the belt end as described as wrapped about the pins 39, 41. In forming the belt end by use of the anchor housing 11, a pin is placed in the outer openings 17 and another pin is placed in the lower openings 21. The belt, as is shown in FIG. 3*a*, is passed down around the pin in the lower openings 21 and up over between the belt 43 itself and the pin in the outer openings 17. The pin is then removed from the lower openings 21, moved to the inner openings 19 with the belt 43 on it. After relocating the pin to the inner openings 19 from the lower openings 21, the anchor housing 11 is moved ninety degrees clockwise as shown in FIGS. 3*a* and 3*b* so as to avoid misforming the belt 43. Then, as shown in FIG. 3*c*, the anchor housing 11 is moved back ninety degrees counterclockwise with the belt 43 held vertically thereby bending the belt 43 ninety degrees about the pin in the outer openings 17. The pin in the inner openings 19 is then removed; and, as shown in FIG. 3*d*, the portion of the belt 43 previously engaging the pin in the inner openings 19 is placed on a pin in the outer openings 17. The belt 43 is swung around and a pin is placed in the inner openings 19 under the belt 43 as is shown in FIG. 3*e*. The belt 43 is then pulled outwardly and the anchor housing 11 is again turned 90° counterclockwise so the belt 43 is in position, as shown in FIG. 3*f*, for bolting with the belt 43 extending vertically upward to go about the structure 45.

Figure 4:
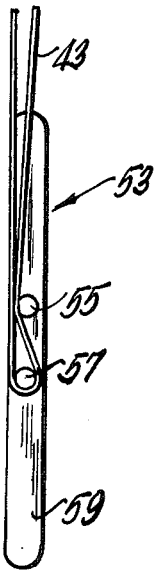
FIG. 4 is a side elevation of a winding tool used to form the strap for connection to the two pins of the anchor housing when the anchor housing itself is not used for that purpose.

As an alternative to the use of lower openings 21, with the anchor housing 11 for the forming of the belt for connection to the outer pin 39 and inner pin 41, a tool 53 as shown in FIG. 4 may be used. As part of the tool 53, a pair of pins 55, 57 are formed on a turn handle 59. The belt 43 is placed on the two pins 55, 57 with the handle 59 straight up and down in a vertical position and the belt 43 in a vertical position. The strap is brought down around the lower pin 57 and up on the inside between the belt 43 and the upper pin 55 similar to the arrangement shown in FIG. 3*a* with the anchor housing 11. The vertically located handle 59 is then rotated three quarters of a turn. Then the strap is placed in the anchor housing 11 as shown in FIG. 3*f*.

With the pins 39, 41 in place and the belt 43 in place, the anchor housing 11 is placed upon the threaded shaft or bolt 25 and is bolted down by the nuts 29, 31 until adequate tension on the belt 43 is obtained. The tie rod 49 is then connected and the turn buckle 51 tightened to create tension in the tie rod 49. The anchor housing 11 is then in place and secured.

Obviously, many modifications and variations of the present invention are possible in light of the above teachings. It is therefore to be understood that within scope of the appended claims the invention may be practiced by those of ordinary skill of the art other than as specifically described.

I claim:

1. An anchoring system for securing a structure to the ground, comprising:

an elongated flexible belt, said belt being adapted to pass over said structure;

first and second anchor housing means for location on opposite sides of said structure, both said first and said second anchor housing means being elongated hollow members with an outer pair of horizontally-aligned openings and an inner pair of horizontally-aligned openings, said outer pair of horizontally-aligned openings and said inner pair of horizontally-aligned openings being adjacent one another and adjacent one end of said anchor housing means, said outer pair of horizontally-aligned openings being located nearer said one end of said anchor housing means than said inner pair of horizontally-aligned openings, each of said first and second anchor housing means having at least one pair of vertically-aligned openings located substantially midway between its two ends;

an outer pin located in said outer pair of horizontally-aligned openings and an inner pin located in said inner pair of aligned openings, said flexible belt engaging both said outer pin and said inner pin with at least three layers of said flexible belt engaging said outer pin;

fastening means, said fastening means being secured to each anchor housing means at the opposite end from said outer and inner pairs of horizontally-aligned openings;

means engaging said vertically aligned openings for securing each anchor housing means to the ground; and tie bar means located at one end to said fastening means and at the other end to said structure.

2. An anchoring system according to claim 1 wherein said outer pair of horizontally-aligned openings and said inner pair of horizontally-aligned openings are horizontally-aligned with one another.

3. An anchoring system according to claim 1 wherein said flexible belt is wrapped under said outer pin and inner pin, over said inner pin and outer pin, back down under said outer pin and diagonally up over said inner pin and back under said inner pin and said outer pin.

4. An anchoring system according to claim 1 wherein said means engaging said vertically-aligned openings is a circular bar imbedded in the ground with a threaded end exposed above the ground and located through said vertically-aligned openings, a pair of nut means operatively engaging said threaded end, one nut means engaging the upper surface of said anchor housing and the other nut means engaging the lower surface of said anchor housing.

5. An anchoring system according to claim 1 wherein said tie bar means is an elongated cable.

6. An anchoring system according to claim 5 wherein said tie bar includes a turn buckle.

7. An anchoring system according to claim 1 including a lower pair of horizontally-aligned openings.

8. An anchoring system according to claim 7 wherein said lower pair of horizontally-aligned openings are vertically aligned with said outer pair of horizontally-aligned openings.

9. An anchoring system according to claim 3 wherein including a lower pair of horizontally-aligned openings.

10. An anchoring system according to claim 9 wherein said lower pair of horizontally-aligned openings are vertically aligned with said outer pair of horizontally-aligned openings.

* * * * *